United States Patent [19]

Falchetti

[11] Patent Number: 4,772,219

[45] Date of Patent: Sep. 20, 1988

[54] ADAPTER BASE FOR REED-TYPE FUSES

[75] Inventor: Antonio Falchetti, Codogno, Italy

[73] Assignee: Meccanotecnica Codognese S.p.A., Codogno, Italy

[21] Appl. No.: 86,995

[22] Filed: Aug. 19, 1987

[30] Foreign Application Priority Data

Nov. 17, 1986 [IT] Italy ..... 23707/86[U]

[51] Int. Cl.[4] ..... H01R 13/717

[52] U.S. Cl. ..... 439/490; 439/622; 337/266; 340/638

[58] Field of Search ..... 337/241, 242, 265, 266; 340/638, 639, 641; 439/621, 622, 490, 488, 489

[56] References Cited

U.S. PATENT DOCUMENTS

| | | | |
|---|---|---|---|
| 3,465,280 | 9/1969 | Paganelli | 340/638 |
| 4,499,447 | 2/1985 | Greenberg | 337/266 |
| 4,514,723 | 4/1985 | Leal | 340/639 |

FOREIGN PATENT DOCUMENTS

| | | | |
|---|---|---|---|
| 990762 | 9/1951 | France | 337/242 |
| 2058493 | 4/1981 | United Kingdom | 337/265 |
| 2063589 | 6/1981 | United Kingdom | 337/242 |

*Primary Examiner*—Gil Weidenfeld
*Assistant Examiner*—Gary F. Paumen
*Attorney, Agent, or Firm*—Butler & Binion

[57] ABSTRACT

An adapter base for reed-type fuses, of the kind usually installed in fuse carriers on passenger cars, comprises a pair of blades each provided at one end with a socket, and a microlamp having rheophores each connected electrically to a respective one of said blades.

The adapter base can be retrofitted to passenger car fuse carriers and affords illumination of a burned out fuse from the time when the failure occurs.

4 Claims, 1 Drawing Sheet

ADAPTER BASE FOR REED-TYPE FUSES

DESCRIPTION

This invention relates to an adapter base for reed-type fuses, particularly for use in vehicle-mounted fuse carriers.

As is well-known, fuse carriers are widely employed on all kinds of vehicles, in particular on passenger cars, but are usually placed in recesses concealed from view and not easily accessed to.

This involves the drawback of making quick location of a burned out fuse among the many that may usually comprise a fuse carrier assembly more difficult.

The technical problem underlying this invention is to provide an adapter base, particularly for so-called reed fuses, which enables quick location of any burned out fuse, thus obviating the above-mentioned drawback.

This problem is solved by an adapter base being characterized in that it comprises a pair of blades, each having one end provided with a fuse socket and a microlamp having rheophores connected electrically to said blades.

Figure 1:
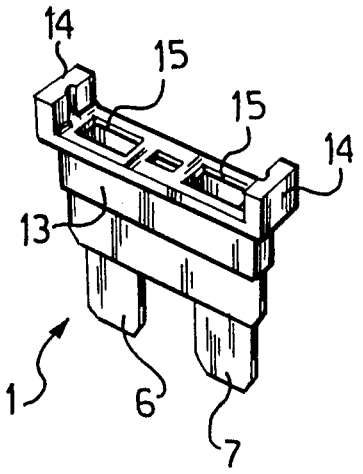
Figure 2:
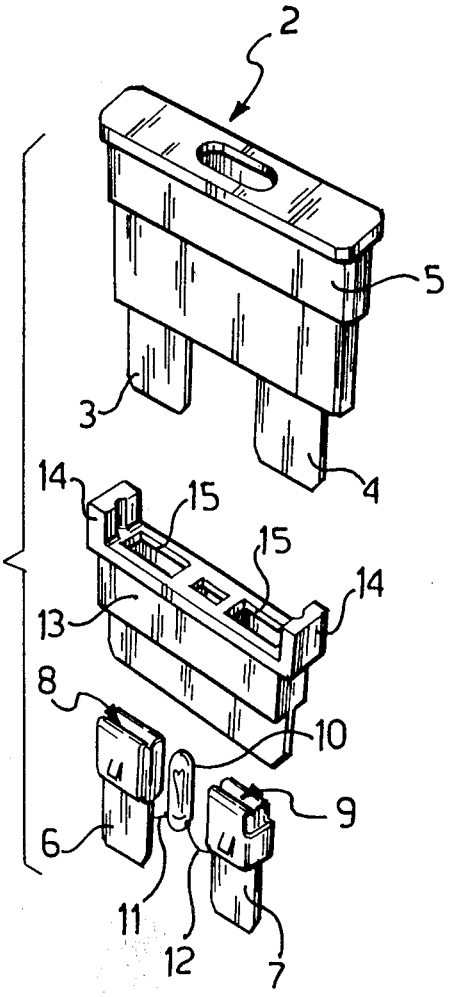

The features and advantages of this invention will become apparent from the following description of an exemplary embodiment thereof, given here by way of illustration and not of limitation with reference to the accompanying drawing figures, whereof:

FIG. 1 is a perspective view of an adapter base for reed fuses, according to the invention; and FIG. 2 is an exploded perspective view of the adapter base shown in FIG. 1 and a fuse to be inserted therein.

With reference to the drawing figures, the numeral 1 generally designates an adapter base according to the invention for a reed-type fuse 2 of the kind installed on vehicle-mounted fuse carriers.

The reed fuse 2 is a conventional one comprising a pair of reed-like contacts, or reeds 3 and 4. The reeds 3 and 4 lie parallel to each other and are accommodated in a body 5 of a clear plastics synthetic material and have a fuse filament, not shown, secured transversely therebetween.

The adapter base 1 comprises, in turn, a pair of blades 6 and 7 parallel to each other. Said blades 6 and 7 are each provided with a socket 8 for the blade 6, and a socket 9 for the blade 7, respectively, for receiving a corresponding blade 3 and 4 of the fuse 2.

Advantageously, according to the invention, between the blades 6 and 7 of the base 1 there is installed a microlamp 10 having rheophores or wires 11 and 12 connected electrically to the blades 6 and 7, respectively.

A body 13 of a clear plastics synthetic material encloses the microlamp 10 and the socket portions 8 and 9 of the blades 6 and 7. The body forms a stiffening stringer for the blades. The body 13 also provides support for the fuse 2 and has fuse holding shoulders 14 and holes 15 in axial alignment to the sockets 8 and 9 for receiving the reeds 3 and 4 of the fuse 2.

The adapter base of this invention is fitted over a pair of electrode clips on the fuse carrier. The fuse 2 is in turn fitted to the adapter base 1, which is structurally independent of both the fuse and the fuse carrier.

In the event of the fuse 2 being burned out, the microlamp 10, being no longer shorted out electrically by the fuse filament, will turn on because of being supplied with a voltage and illuminate the burned out fuse, thus making it easily recognizable among those housed in the fuse carrier.

The adapter base of this invention affords the unique advantage of being usable with fuse carriers of passenger cars already in operation. Furthermore, this adapter base is structurally independent of the fuse and stays with the fuse carrier. Replacement of burned out fuses is accomplished using ordinary fuses as employed conventionally.

I claim:

1. An adapter base particularly for use in vehicle-mounted fuse carriers, characterized in that it comprises a pair of plug blades, adapted to be inserted into a fuse carrier, a socket formed at one end of each blade which are each adapted to accept a blade of a fuse, and a microlamp having rheophores connected electrically to said blades, whereby when a fuse electrically connected to the adapter base burns out, the microlamp is illuminated.

2. An adapter base according to claim 1, characterized in that it comprises a fuse holder body enclosing said microlamp and the socket portions of said blade pair.

3. An adapter base according to claim 2, characterized in that said holder body is formed from a clear plastics synthetic material.

4. An adapter base according to claim 2, characterized in that said holder body includes shoulders for holding and guiding said fuse.

* * * * *